US006321816B1

(12) United States Patent
Koreska

(10) Patent No.: US 6,321,816 B1
(45) Date of Patent: Nov. 27, 2001

(54) REEL ARRANGEMENT

(75) Inventor: Peter Koreska, Vienna (AT)

(73) Assignee: Kores Holding Zug AG, Zug (CH)

( * ) Notice: Subject to any disclaimer, the term of this patent is extended or adjusted under 35 U.S.C. 154(b) by 0 days.

(21) Appl. No.: 09/446,970

(22) PCT Filed: Apr. 28, 1998

(86) PCT No.: PCT/AT98/00111

§ 371 Date: Dec. 30, 1999

§ 102(e) Date: Dec. 30, 1999

(87) PCT Pub. No.: WO99/01368

PCT Pub. Date: Jan. 14, 1999

(30) Foreign Application Priority Data

Jun. 30, 1997 (AT) ..... 1116/97
Jan. 9, 1998 (AT) ..... 0020/98

(51) Int. Cl.[7] ..... B32B 31/00

(52) U.S. Cl. ..... 156/577; 156/523; 156/579; 118/76; 242/160.4; 242/171; 242/588.6

(58) Field of Search ..... 156/238, 540, 156/523, 527, 574, 577, 579; 225/46; 242/588.2, 588.6, 160.2, 160.4, 588, 588.3, 170, 171; 118/76, 200, 257

(56) References Cited

U.S. PATENT DOCUMENTS 5,685,944 * 11/1997 Nose et al. ..... 156/540
6,062,286 * 5/2000 Koyama et al. ..... 156/540

FOREIGN PATENT DOCUMENTS 41 04 331 8/1992 (DE) .
0 368 070 5/1990 (EP) .

OTHER PUBLICATIONS

Patent Abstracts of Japan vol. 096, No. 005, May 31, 1996–& JP 08 011494 A (Shiyachihata Kogyo KK), Jan. 16, 1996, see abstract.

Patent Abstracts of Japan vol. 097, No. 004, Apr. 30, 1997–& JP 08 337095 A (Tombow Pencil Co Ltd), Dec. 24, 1996, see abstract.

* cited by examiner

*Primary Examiner*—Mark A. Osele
(74) *Attorney, Agent, or Firm*—Pillsbury Winthrop LLP

(57) ABSTRACT

A reel arrangement (8) for a device for transferring a film (2) located on one side of a foil tape (1) to a substrate, comprising a feed reel (4) for the foil tape (1), a take-up reel (5) for the foil tape (1) after the film (2) has been transferred, said take-up reel being coaxial with the feed reel (4), and a friction coupling (9) between the two reels (4, 5) so as to drive the take-up reel (5) from the feed reel-(4) side under slipping, wherein the friction coupling (9) comprises radially resilient arms (30) which are non-rotationally connected with the feed reel (4) and which engage an end face groove (26) on the take-up reel (5) by means of engaging projections (28), the engaging projections (28) frictionally abutting the groove walls (32, 33).

45 Claims, 6 Drawing Sheets

FIG. 11
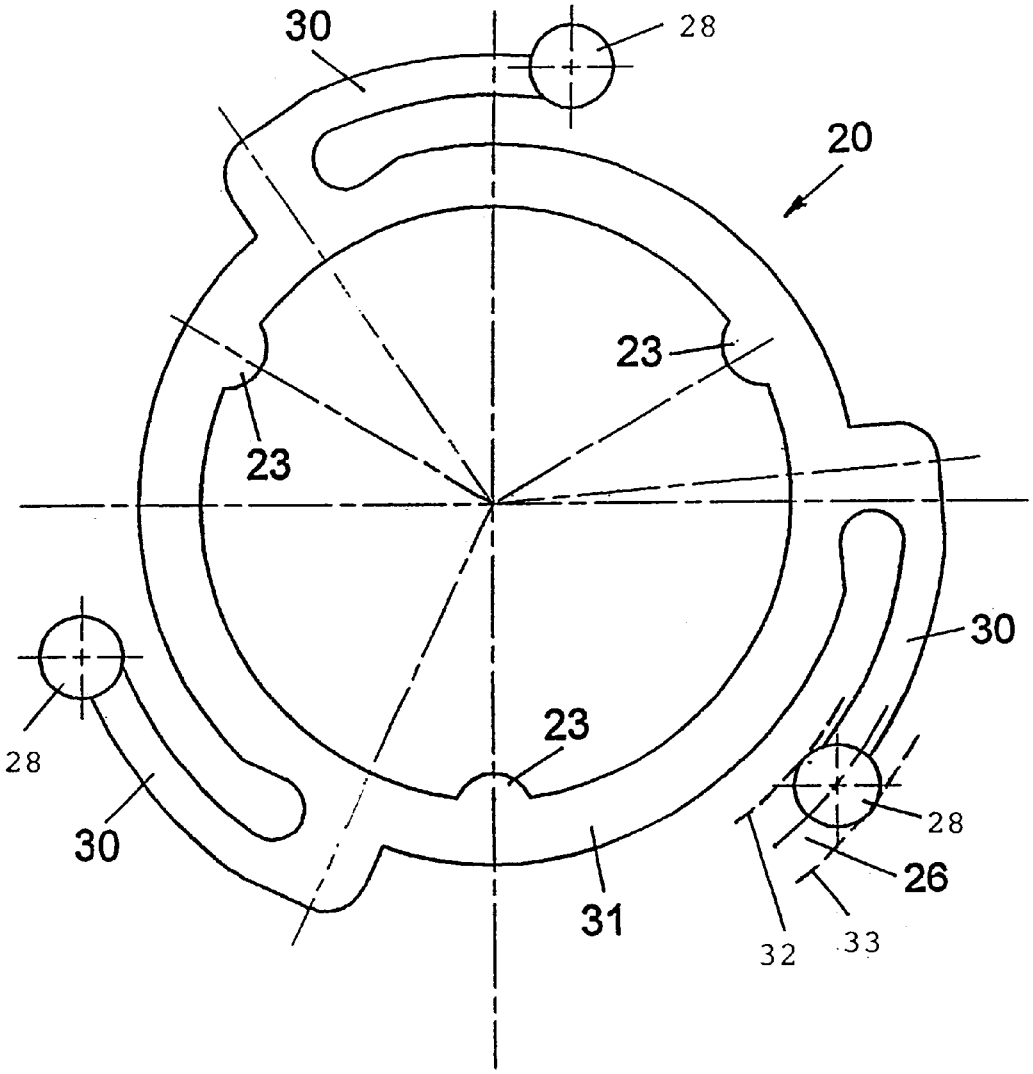
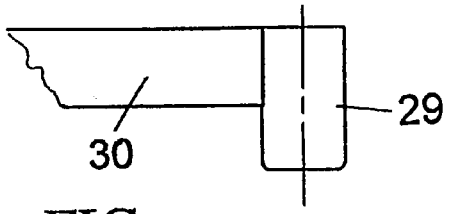
FIG. 12

REEL ARRANGEMENT

This application is the national phase of international application PCT/AT98/00111 filed Apr. 28, 1998 which designated the U.S.

The invention relates to a reel arrangement for a device for transferring a film located on one side of a foil tape to a substrate, comprising a feed reel for the foil tape, a take-up reel for the foil tape after the film has been transferred, said take-up reel being coaxial with the feed reel, and a friction coupling provided between the two reels so as to drive the take-up reel from the feed reel side under slipping.

Devices for transferring adhesive films or correction colour films, or reel arrangements therefor, respectively, have become known in varying embodiments. Thus, e.g., DE 37 36 367 C shows a hand device for transferring a film from a carrier foil to a substrate, in which the tape-shaped carrier foil is reeled off a first reel, guided over an applicator, where the film is transferred to a substrate, e.g. paper, and then is reeled up again on a second reel. The two reels are arranged separate from each other, and the tape plane of the carrier foil remains unchanged during the entire procedure. Thus, this device is comparatively awkward as a hand-used device since, due to the two successively arranged reels, it must be rather large and, furthermore, must be actuated in a relatively uncomfortable position of the hand, the hand extending over the top of the device, by its back inhibiting the view of the location of transfer.

Similar hand-used devices having successively arranged feed and take-up reels, having the drawbacks described, are disclosed in EP 427,870 A. Moreover, this document also shows a hand device having a co-axial arrangement of feed and take-up reels, a friction coupling being realized between the two reels by means of a sphere against which the two reels are axially forced by aid of springs. This embodiment, however, also gives rise to an awkward, large structural height of the device, apart from the expenditures at production and the cumbersome mounting of the spring-biased reels in the housing.

An other hand-used device which is to be held and actuated similarly is known from U.S. 5,380,395 A, in which the feed reel simultaneously serves as application device for adhesive members resting on the carrier tape. Although in this case the tool as such is compact and small—because the used tape is guided out of the housing and can be cut off—, the tape projecting from the housing is experienced as hindering. Moreover, the user cannot control the exact application site very well.

In EP 368,070 A, furthermore, a hand-used device is described in which the axes of the feed and take-up reels are inclined relative to each other by an angle. Between the reel hubs, a kind of toothed coupling is active, the one set of teeth being arranged on separate, elastic coupling ratchets. Thereby, the thus realized coupling can slip with a correspondingly high safety torque, by the teeth sliding above one another, with the coupling ratchets resiliently bending inwardly. This design is, however, extremely complex and expensive to produce, and, moreover, also the slip torque can be controlled with little exactness only.

DE 196 09 533 C1 discloses a gear arrangement for a take-up reel of a transfer dispenser wherein an annular sleeve is provided with an external toothing which meshes with an internal toothing on the reel core of the feed reel. Hence follows that both reels are not and cannot be arranged coaxially, i.e. the axes of the two reels are provided at a distance from each other, which renders their connection to a unit in the manner of an exchangeable cassette difficult and increases the costs therefor and the dimensions of the reel arrangement. Slipping of the take-up reel is enabled by radial supporting webs integral with the annular sleeve and resilient webs extending from the radial supporting webs approximately at right angles, the resilient webs contacting the inner circumference of the reel core of the take-up reel under resilient bias. It is not possible to exactly determine the torque range with respect to an entrainment or slipping of the take-up reel, i.e. particularly also when taking into consideration the dimensional changes of the respective parts in case of temperature variations, apart from the fact that the annular sleeve forming the friction coupling being comparatively complex to produce with its supporting and resilient webs on the one hand and the external toothing on the other hand.

Finally, from EP 377,085 A a device for applying an adhesive film and comprising co-axial arrangement of feed and take-up reels is known, wherein, moreover, a friction or slip coupling is operating between the two reels. This, however, is a (particularly magnetic) disk coupling, axially directed surfaces contacting each other and, if need be, being capable of slipping relative to each other. Also this device is comparatively unprecise and rough in terms of torque control, so that the tape is liable to tear.

In this connection it should be mentioned that the transmission of torque in the transfer devices of the type mentioned here is relatively delicate; when drawing off the full tape from the feed or supply reel, when applying a correction colour film or an adhesive film or the like to the respective substrate, this feed reel is driven, the latter being intended to drive the take-up reel via the friction coupling, so that the foil tape from which the film has now already been transferred will be wound up accordingly on the take-up reel. The drive of both reels thus strictly speaking is effected in the region of the applicator, by displacing the device over the substrate while drawing off the foil tape, so that the latter is reeled off the feed reel. The feed reel has a smaller tape coil diameter or reel hub diameter as compared to the take-up reel, so that with an equal number of revolutions of the two reels, a higher peripheral speed and thus a higher tape speed would be caused on the take-up reel. This is where the function of the friction coupling enters, which must allow for a slipping of the take-up reel so as to arrive at equal tape speeds both at the feed reel and at the take-up reel. The friction or slip coupling thus must be dimensioned within an extremely narrow torque range so as to ensure an adequate tension in the foil tape both at the start of use of the device, when there is still a full tape coil on the feed reel, (whereas on the take-up reel there will be only one or two layers of foil tape,) and towards the end of use, when the almost complete foil tape has been wound up on the take-up reel, so that there the tape coil will have a correspondingly even larger diameter as compared to the tape coil on the feed reel, so that the tape will be guided neither too loosely (so that it would in particular be reeled off into a loop on the outside of the device), nor tensioned too much (in which case it would tear). Thus, the friction coupling should ensure a corresponding torque transmission, or a slipping, respectively, with the friction being dimensioned accordingly. For this, the afore-mentioned known embodiments have all proved to be too unprecise and unsuitable. Above all, tests have shown that friction coupling systems based on a resilient bias of components relatively quickly change the characteristics due to fatigue or temperature influences, in particular lose friction, so that the tape will no longer be reeled up.

It is now an object of the invention to provide a reel arrangement of the initially defined type which not only allows for a compact and handy construction and a comfortable control of the transmission procedure when using the associated device, but also reliably allows for an exact control of the torque transmission and definition of the safety torque over extended periods of time so as to always keep the foil tape under an adequate tension without tearing the latter and without the possible formation of a loose loop.

The reel arrangement according to the invention and of the initially defined type is characterized in that the friction coupling comprises at least one radially resilient arm which is non-rotationally connected with the one reel and which engages an end face cam guide on the other reel by means of an engaging projection, the resilient arm being capable of being deflected radially inwardly and outwardly.

With the reel arrangement according to the invention, thus a friction coupling is provided which is based on the fact that the resilient arm(s) engage in the cam guide and thus cause the take-up reel to be frictionally entrained, the frictional engagement in the cam guide being possible radially inwardly or radially outwardly; in particular, the resilient arms can be deflected from their relaxed resting state slightly radially inwards or outwards in the course of a relative rotation between the reels, i.e. they may be deformed elastically; in this case, the friction values on the outside or on the inside of the cam guide may vary, yet the total friction can remain approximately constant, even in case of dimensional changes due to temperature variations. Moreover, it is not only possible to obtain a compact reel unit, in particular in an embodiment comprising an exchangeable cassette which can be inserted into the respective device in the pre-mounted state, but it is also possible to house the radially acting friction coupling in a space-saving manner (attaining a low structural height of the device) as well as to dimension it exactly in terms of the torque determination so that a safe function of the device with the foil tape always adequately tensioned will be obtained. Tearing of the foil tape is avoided just as is the formation of loose loops outside of the housing of the device.

For the compact design sought, it has proven advantageous if the resilient arm is connected with the feed reel, and the cam guide is provided on the take-up reel.

The cam guide could be formed by a separate construction element which is non-rotationally connected with the other reel, preferably the take-up reel, in any manner, e.g. via a wedge connection. With a view to a simple production, particularly by injection moulding, it is, however, particularly advantageous if the cam guide is formed by an end face groove on the other reel.

In practical experiments it has, furthermore, proven to be a particularly advantageous compromise in terms of as simple a construction as possible by injection moulding, on the one hand, and as smooth and reliable a co-rotation or slipping of the take-up reel relative to the feed reel, on the other hand, if three resilient arms are provided at respective angular distances of 120°.

To achieve a defined frictional engagement of the resilient arm(s) with the cam guide or end face groove, respectively, it is furthermore also advantageous if the, or each, respectively, resilient arm is provided with an engaging pin extending in parallel to the axis of the reels and projecting axially. Preferably, the engagement pins are designed to be cylindrical, and because they can be well dimensioned, even if they are produced by injection moulding, a well defined frictional engagement within comparatively narrow limits can be ensured, with the resilient arms being deflected elastically. In case several resilient arms are provided, the engaging pins preferably will be arranged according to an imaginary circle, with a view to a simple production.

In practice it has also proven suitable if the, or each, respectively, resilient arm with its freely cantilevering end is directed contrary to the rotational direction at a relative rotation between the two reels.

The resilient arm(s) as such may also be formed in one piece with the reel, preferably with the feed reel; yet, to provide for a simple production of the individual components as well as to optionally adapt the spring characteristics within the friction coupling to certain conditions, e.g. to different foil tapes, it is particularly advantageous if the, or each, respectively, resilient arm is moulded to a ring which is non-rotationally arranged on the hub of the one reel. To achieve a non-rotational locking in a simple manner by avoiding a slippage between the ring and the reel, it is furthermore adavantageous if the ring on its radially inner side has at least one projection which engages in a depression on the hub periphery of the one reel.

As such it would also be conceivable to provide several radially resilient arms with their portions engaging in the cam guide in the resting state on different radii and to design the cam guide for the resilient arms circularly. With a view to a simple production as well as furthermore to a uniform guidance of the arms at the relative rotation between the reels it has, however, proven particularly advantageous if the cam guide, seen in top view, has a shape deviating from the circle shape. In this case, the resilient arms will be deflected radially inwardly and radially outwardly in a phase-shifted manner, for which purpose the cam guide may, e.g., be a generally circular guide closed within itself and provided with a undulation; the undulation superimposed on the circle shape is to be made such in relationship to the positions of the resilient arms that at any desired point of time, always at least one of the resilient arms is deflected radially outwardly and at least one resilient arm is deflected radially inwardly so as to always achieve an appropriate friction on the cam guide by resilient bias, which ensures entrainment of the take-up reel with the feed reel up to the pre-determined torque at which the resilient arms are radially displaced from their at-present positions, when the cam guide, overcoming the friction, slides over them. Yet also in this case it is particularly suitable with a view to a smooth operation and a steady entrainment of the take-up reel if the cam guide has an elliptic shape, seen in plan view.

Tests have shown that for attaining the friction required for an entrainment of the take-up reel under slipping in the necessary torque region, in the previously described embodiment a surprisingly slight deflection of the resilient arms is sufficient, or is to be provided, respectively, and in particular it is suitable in this instance if the extent of deflections of the resilient arms radially inwardly as well as radially outwardly each amount to approximately 0.3 to 0.5 mm, preferably approximately 0.4 mm. In a practical embodiment, in this instance the resilient arms with their engaging portions, in particular the engaging pins, may be located on a circle, and the cam guide may, e.g., have an elliptic shape whose long axis is larger by approximately 0.4 mm than the circle diameter, and whose short axis is smaller by approximately 0.4 mm than the circle diameter of the resilient arms. In this manner, a deflection of the resilient arms by approximately ±0.4 mm is obtained during the relative rotation between the reels.

Tests have shown, on the other hand, that friction coupling systems based on a resilient bias of components, because of fatigue or temperature influences, may change their characteristics, in particular lose friction so that the tape will no longer be reeled up.

A particular aim of the invention thus resides in designing the present reel arrangement such that it not only enables a compact and handy mode of construction, as has been mentioned, and allows for a comfortable checking of the transfer procedure when the associated device is being used, but particularly also allows for a reliable exact control of the torque transmission and definition of the safety torque over long periods of time and in wide temperature ranges so as to always keep the foil tape adequately tensioned without tearing the same and without enabling the formation of a loose loop.

To achieve this, it is particularly advantageously provided that the cam guide is designed to be circular and comprises a radially inner wall as well as a radially outer wall, and that the, or each, respectively, engaging projection engages both walls. With this reel arrangement, a friction coupling is provided which is based on the friction on account of the mere abutting of the, or each, respectively, engaging projection both radially inwardly and radially outwardly on the respective wall of the cam guide, whithout a resilient bias of the resilient arm(s) being provided or being required, respectively. If the diameters of the walls change, e.g. increase, in case of temperature changes, e.g. a rise of the temperature, the resilient arms—if required at all—follow such temperature-caused elongation or contraction, due to their resilient deflection, wherein the resilience occurring in this case can be comparatively slight as compared to the frictional force already prevailing so that the overall friction and thus the safety torque will change only slightly. In the present case, the resilient arm(s) also make it possible to compensate possible deviations in the coaxial arrangement of the reels, e.g. due to tolerances and/or different play, in that also in that case, at the relative rotation between the reels, as required, the resilient arm(s) can be deflected radially inwardly or outwardly from its (their) relaxed resting position, i.e. can be elastically deformed, while nevertheless always abutting with its (their) engaging projection(s) both radially outwardly and also radially inwardly.

The cam guides could be formed as a separate construction part which is non-rotationally connected with the other reel, preferably the take-up reel, in any manner, e.g. via a wedge connection.

For a simple production of the reel arrangement, in particular by injection moulding of the individual parts with narrow tolerances, it is also advantageous if the bottom of the groove forming the cam guide is part of a disk-shaped base body of the other reel from which the walls as well as a tape-coiling cylinder project axially on one side thereof.

Here, too, the resilient arm(s) may form a separate coupling body which is positively coupled with the one reel as a separate construction part, or they (it) may be formed in one piece with the one reel, preferably the feed reel, so as to realize the non-rotational connection.

In order to reliably ensure a frictional engagement of the engaging projection(s) between the walls of the cam guide under abutment on both walls at any time, also in case of temperature-caused dimensional changes, it is also advantageous if the or each engaging projection is accommodated under slight pressure fit between the walls of the circular cam guide.

The engaging pins preferably are circular-cylindrical, and because they are easy to dimension also in case of a production by means of injection moulding, a well defined frictional engagement within comparatively narrow tolerances can be attained.

In practice, it has also proven suitable if the cam guide has a width of 2 mm, with a tolerance of from 0 to 0.005 mm, and the or each engaging projection has a thickness measured in radial direction of the reels of 2 mm, with a tolerance of from 0 to +0.005 mm.

As the material for the resilient arm(s), optionally the ring carrying the former, as well as the reels, ABS has proven particularly suitable. Reel arrangements made of this plastics material not only have the desired long useful life, but also the friction required in the region of the friction coupling is achieved with sufficient precision.

The invention further relates to a device for transferring a film present on one side of a foil tape to a substrate, comprising a reel arrangement according to the invention.

The invention will now be explained in more detail by way of preferred exemplary embodiments illustrated in the drawings to which, however, it shall not be restricted.

FIG. 11 shows a top view onto the generally annular coupling body that acts between the reels;

FIG. 12 shows a view of a portion of a resilient arm of this coupling body.

Figure 1:
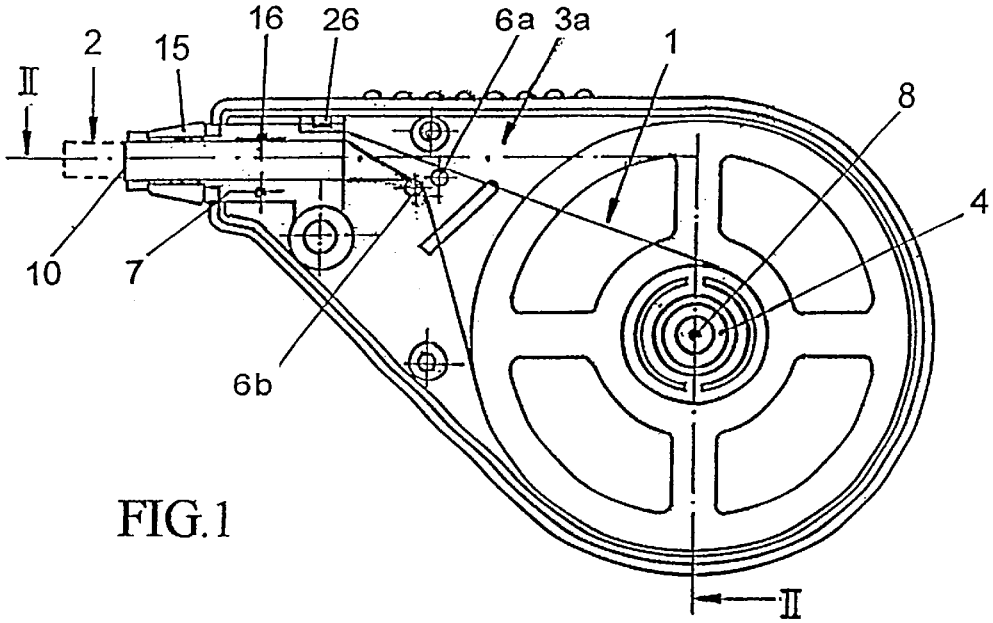
FIG. 1 shows a view of a device for transferring a correcting film with the upper housing lid removed so as to show the reel arrangement housed therein.
Figure 2:
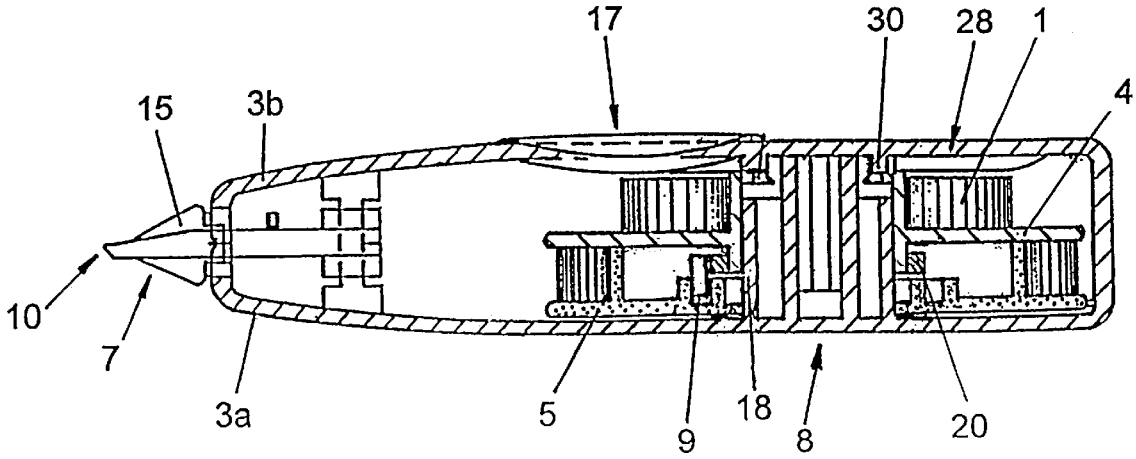
FIG. 2 shows a section along line II—II of FIG. 1 on a somewhat enlarged scale.

In FIG. 1, a device for transferring a film 2 located on one side of a foil tape 1 from the latter to a substrate is shown, the upper housing part being removed; FIG. 2 shows a section according to line II—II of FIG. 1, with the upper housing part 3*b* being put thereonto.

The foil tape 1 is reeled up on a feed reel 4, one side of this foil tape 1 being covered with a film 2 comprising, e.g., a correcting substrate which may be applied in a dry state over a text to be corrected and then may be written on. Likewise, the foil tape 1 may also be covered by an adhesive or dye film. FIG. 1 shows an already relatively empty feed reel 4, which is arranged coaxially to a take-up reel 5, cf. also FIG. 2: From the feed reel, the foil tape 1 is guided over a first deflection guide 6*a* and from there around an applicator 7; in this connection, the foil tape 1 experiences a twist about its longitudinal axis by 90°. In this manner, the foil tape 1 may be sharply deflected at a front edge of the applicator 7 projecting from the housing 3 and designed as a tear-off edge 10, it being possible to transfer the film 2 onto a substrate, such as paper or the like, as indicated in broken lines in FIG. 1. Subsequently, the foil tape 1 is guided around a second deflection guide 6*b*, whereby it again experiences a twist by 90°, and then is guided onto a take-up reel 5 and is reeled up thereon. The two reels 4, 5 thus form a coaxial reel arrangement 8 which forms a handy construction unit as such, as will be explained below in more detail.

The applicator 7 is tongue-shaped and fixed at its end located within the housing 3 at both sides to the lower portion 3*b* thereof, this fixation optionally being releasable on at least one side, as will be explained later on.

The end of the applicator 7 projecting from the housing 3 comprises two parallel, approximately triangular lateral delimitations 15, which, on the one hand, are intended to prevent lateral slipping off of the foil tape 1 and, on the other hand, as is particularly apparent from FIG. 2, constitute a supporting guide of the device while the film 2 is drawn off the foil tape 1 and while the film 2 is transferred to the carrier substrate. Further guides may also be provided on the applicator 7, as illustrated in FIGS. 1 and 2, where they are designed as pin-shaped-projections 16.

Due to the tongue-shaped design and its fastening on one side thereof, the applicator 7 will yield somewhat when being guided over the substrate, e.g. paper, whereby, on the one hand, the pressing force on the substrate is controllable and, on the other hand, a somewhat wider area of contact is provided. The tear-off edge 10 is designed as a rounded edge of small radius so as to enable detachment of the film 2 from the foil tape 1 in a defined manner. This is particularly essential for applying a correction film on a faulty text part, it thereby being possible to cover merely the actually faulty text part. The slight rounding of the edge also has the effect that when applying the film 2 onto the substrate, this substrate—which optionally may be thin copying paper—will not be injured, on the one hand, and that the risk of tearing the foil tape 1 during this application procedure is reduced, on the other hand.

As is clearly apparent from FIG. 2, the feed reel 4 and the take-up reel 5 are mounted co-axially superposed on an axle 18 fixed relative to the housing; the procedure of feeding the foil tape 1 from the feed reel 4 is effected through the tension of the foil tape 1 when applying the film 2 to the substrate. Reeling up the foil tape 1 on the take-up reel 5 is obtained by the movement of the feed reel 4, on account of a friction coupling 9 provided on both reels 4, 5.

FIG. 1, which illustrates the device slightly enlarged as compared to its natural size—here designed as a manual device for application of a correction film—clearly shows that handling of the device is ergonomically comfortable mainly because of the space-saving arrangement of the feed and take-up reels 4, 5, and makes it simpler for the user to check the application of the film 2 on the substrate because of good visibility of the same. By the compact reel arrangement 8, the device rests well in one's hand during the application procedure. For a better guiding of the device, a depression 17 (cf. FIG. 2) is provided in the upper housing part 3*b*, into which a finger, e.g., the thumb of the user, may be put.

Figure 3:
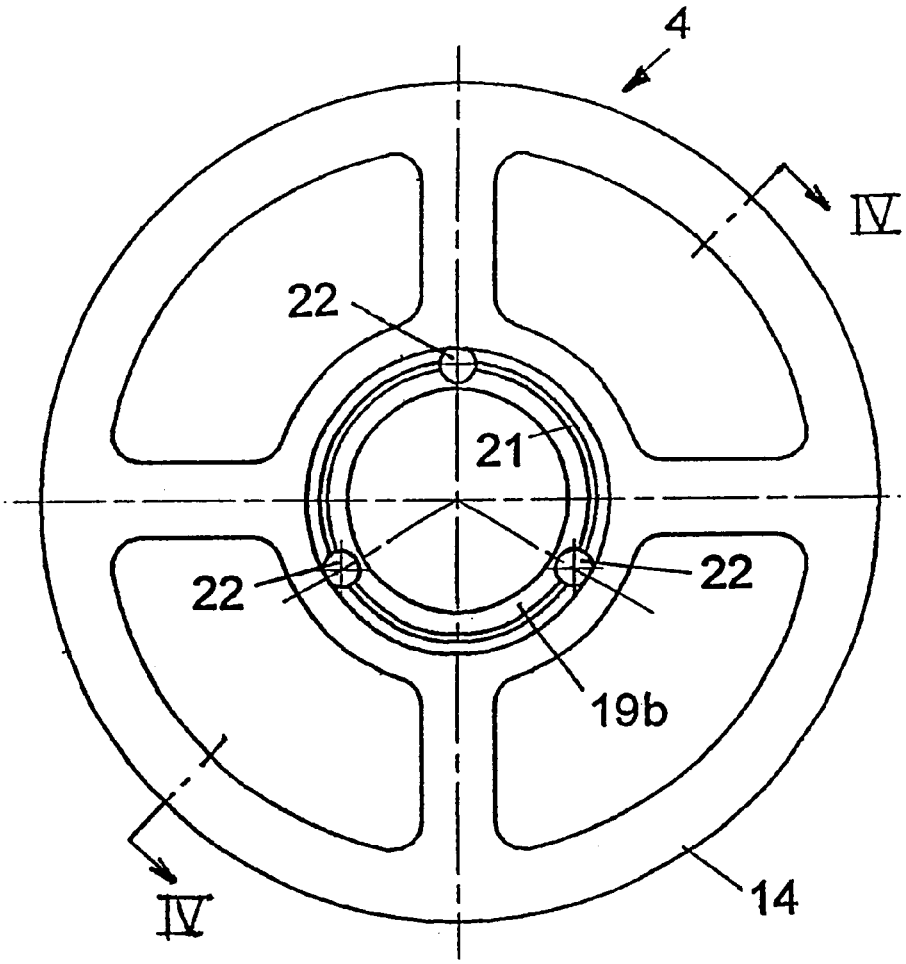
FIG. 3 shows a view of that side of the feed reel of the reel arrangement which faces the take-up reel.
Figure 4:
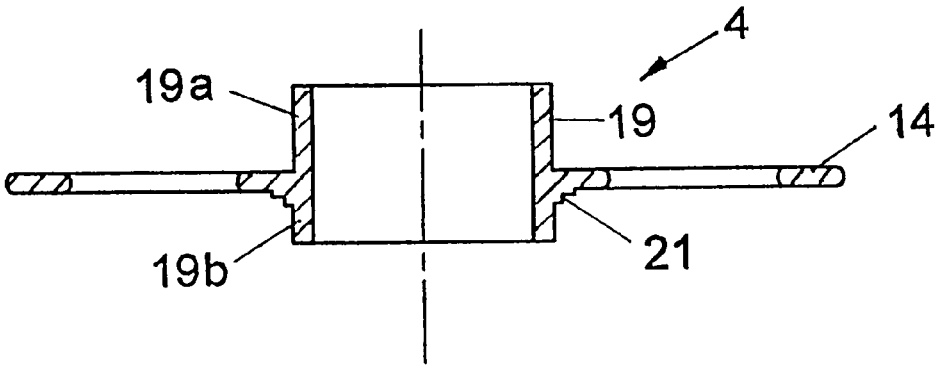
FIG. 4 shows an axial section through this feed reel according to line IV—IV of FIG. 3.

FIGS. 3 and 4 show a top view and a section according to line IV—IV of FIG. 3, respectively, of a feed reel 4. The feed reel 4 is designed as a wheel-like disk 14 provided with spokes having a central sleeve (hub) 19 provided to accommodate the axle 18. The central sleeve 19 projects on either side beyond the disk 14, the foil tape 1 initially being present in reeled-up manner on the upper sleeve portion 19*a* ("upper" as regards the sections illustrated in FIGS. 2 and 4) (cf. particularly FIG. 2, in which a relatively large coil of tape is shown on reel 4). The lower sleeve portion 19*b* cooperates with the take-up reel 5 via the friction coupling 9 which comprises a coupling body 20 merely schematically shown in FIG. 2, cf. FIGS. 7 and 8 and FIGS. 11 and 12, respectively, so as to ensure—by means of the friction coupling 9—that the take-up reel 5 will be entrained by the latter under slipping. This lower sleeve portion 19*b* is provided with at least one depression—three depressions 22 in the embodiment illustrated, also in the region of a peripherally extending stepped projection 21 which depressions cooperate with corresponding radially inward projections 23 of the annular coupling body 20—subsequently termed coupling ring 20 in short (cf. FIGS. 7 and 8 or FIGS. 11 and 12, respectively) so as to lock this coupling ring 20 non-rotationally with the feed reel 4 when the former is put onto the lower sleeve portion 19*b*.

Figure 6:
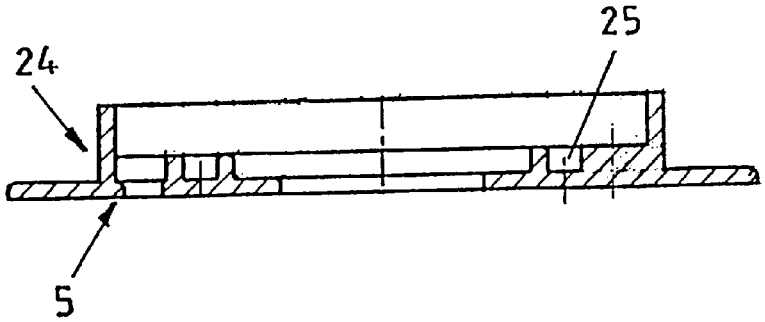
FIG. 6 shows an axial section through this take-up reel according to line VI—VI of FIG. 5.
Figure 5:
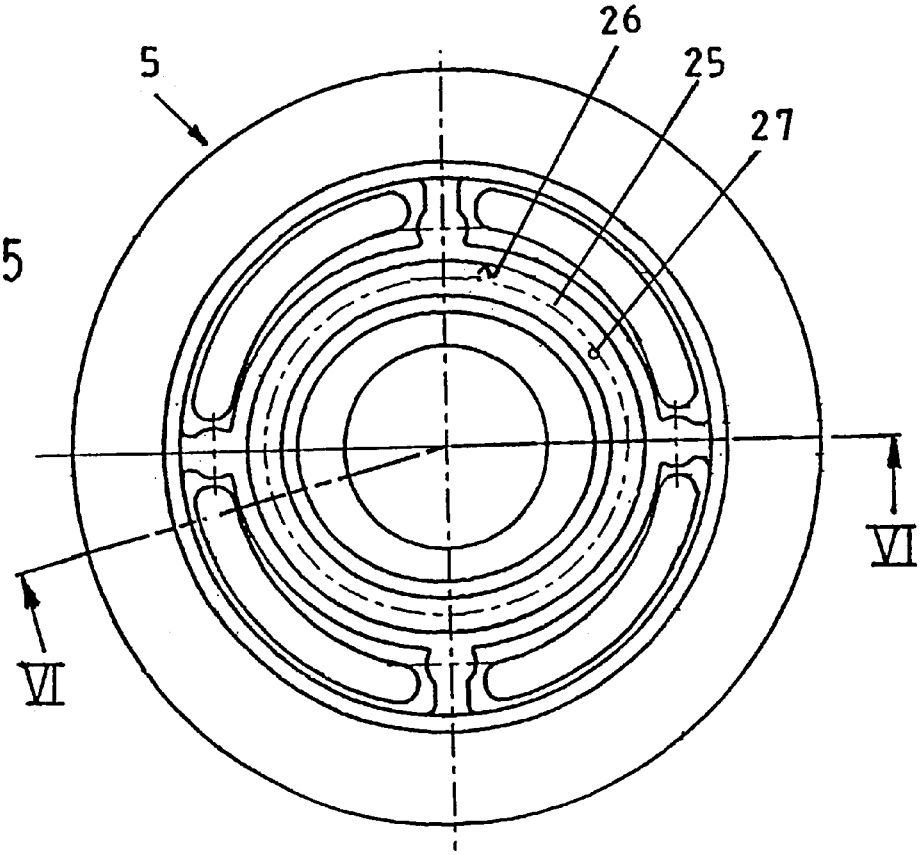
FIG. 5 shows a top view onto the take-up reel so as to illustrate that side thereof which faces the feed reel.

FIGS. 5 and 6 show an embodiment of the take-up reel 5 which is designed generally similar to the feed reel 4, and both reels 4, 5 are light-weight, yet strong, i.a. also because of the skeleton-type shaping of the supporting surface 24 of the take-up reel 5.

In the mounted state of the reel arrangement 8, cf. FIG. 2, the two reels 4, 5 are located axially one behind the other, and in this configuration they are held together non-positively via the coupling ring 20 so as to form a unit manipulatable as such.

For this purpose, the take-up reel 5 has a cam guide 25, as is visible in FIGS. 5 and 6, which in the exemplary embodiment illustrated is formed by a front-side, elliptical groove 26 having radially inner and outer groove walls at a constant distance from each other. In FIG. 5, moreover, an imaginary ellipticl center line of the front-side groove 26 is shown by 27 in broken lines, this center line deviating from a corresponding circular shape such that the long axis of the ellipse, the horizontal axis in FIG. 5, is larger by approximately 0.5 mm to 1 mm than the short axis of the ellipse, the vertical axis in FIG. 5.

Figure 8:
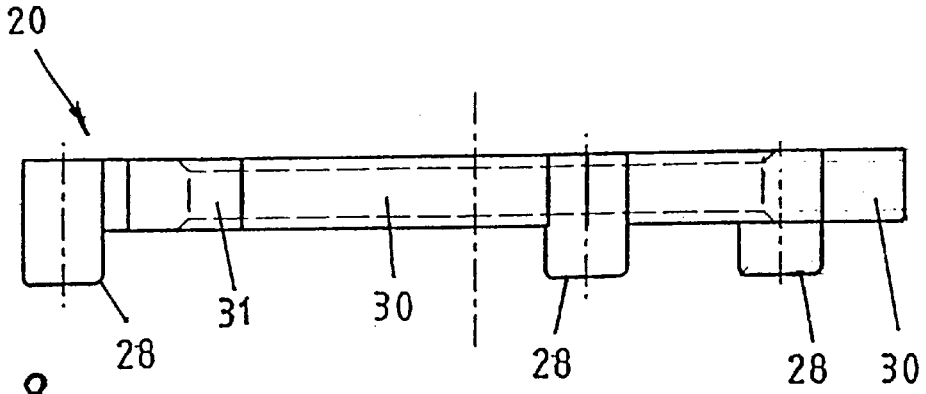
FIG. 8 shows a side view of this coupling body.
Figure 7:
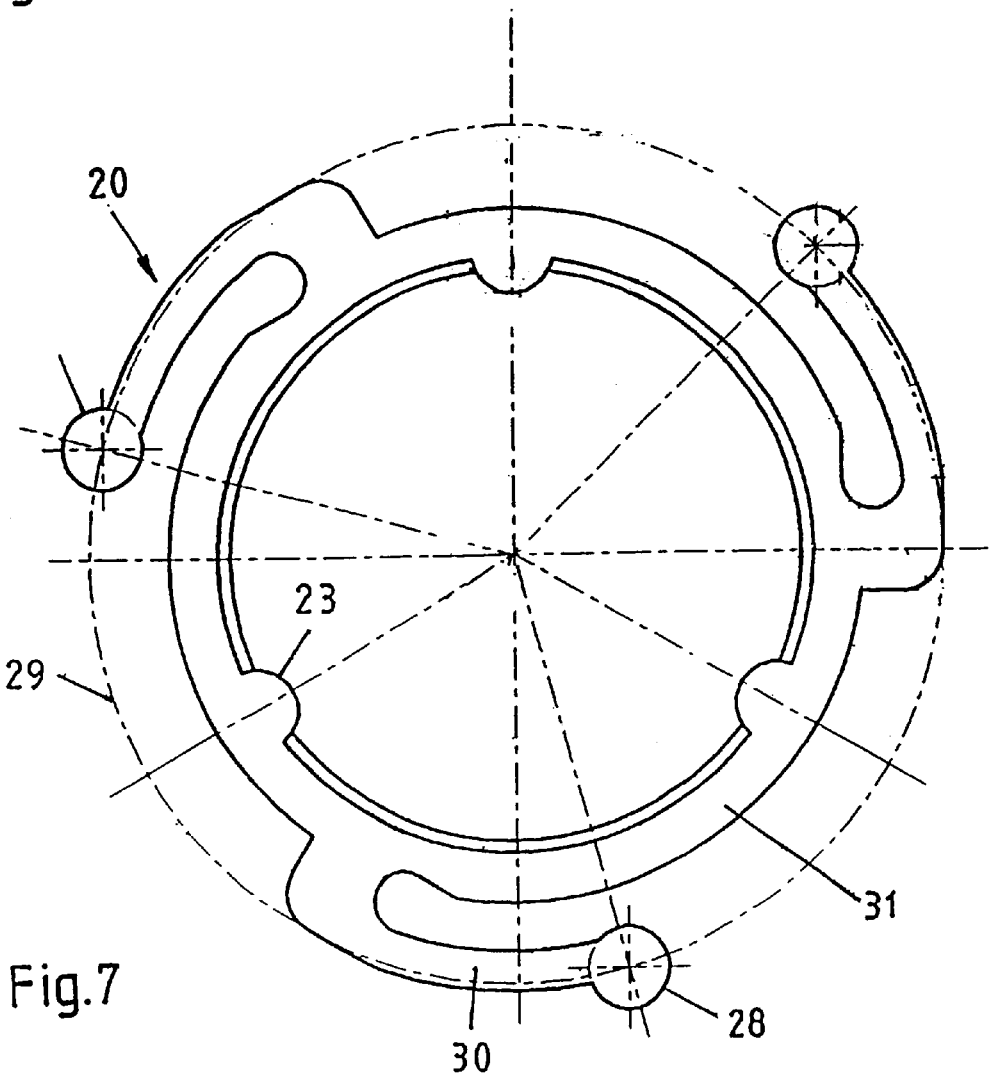
FIG. 7 shows a top view onto the generally annular coupling body that acts between the reels.

On the other hand, the coupling ring 20 has engaging projections in the form of generally cylindrical engaging pins 28, cf. FIGS. 7 and 8, with the centers thereof on a circle line illustrated in FIG. 7 by broken line 29; the diameter of this circle line 29 is located exactly in the middle between the longitudinal extensions of the short axis and the long axis of the ellipse 27 according to FIG. 5.

The engaging pins 28 are moulded to the free ends of resilient arms 30 which extend in peripheral direction, which arms in turn are moulded to the outer side of a ring 31 at angular distances of 120°. Together with the resilient arms 30, this ring 31 forms the afore-mentioned coupling ring 20.

If the engaging pins 28 engage in the groove 26 on the take-up reel 5, always one of the resilient arms 30 is deflected radially inwardly from its resting position illustrated in FIG. 7 in which the engaging pins 28 lie on the circular line 29 with their centers in a relaxed state, and another resilient arm 30 is deflected radially outwardly. By such deflections, or the elastic deformations prevailing in such a case, respectively, the engaging pins 28 always abut on one or the other wall of the groove 26 with a certain force, while nevertheless in the resting position the resilient arms 30 are present with the engaging pins 28 without a bias, so as to ensure that the take-up reel is frictionally entrained by the feed rail under defined slipping over long times of operation and even in case that individual plastics components are exposed to elevated temperatures.

Figure 10:
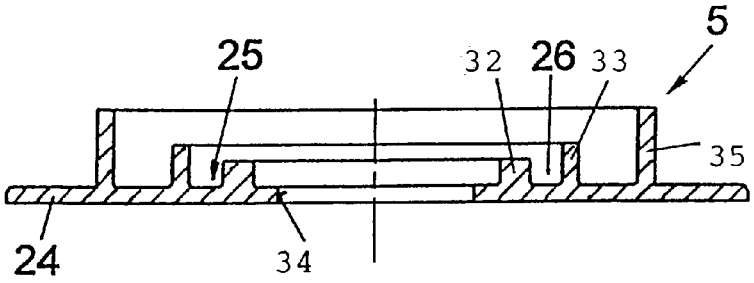
FIG. 10 shows an axial section through this take-up reel according to line X—X of FIG. 9.
Figure 9:
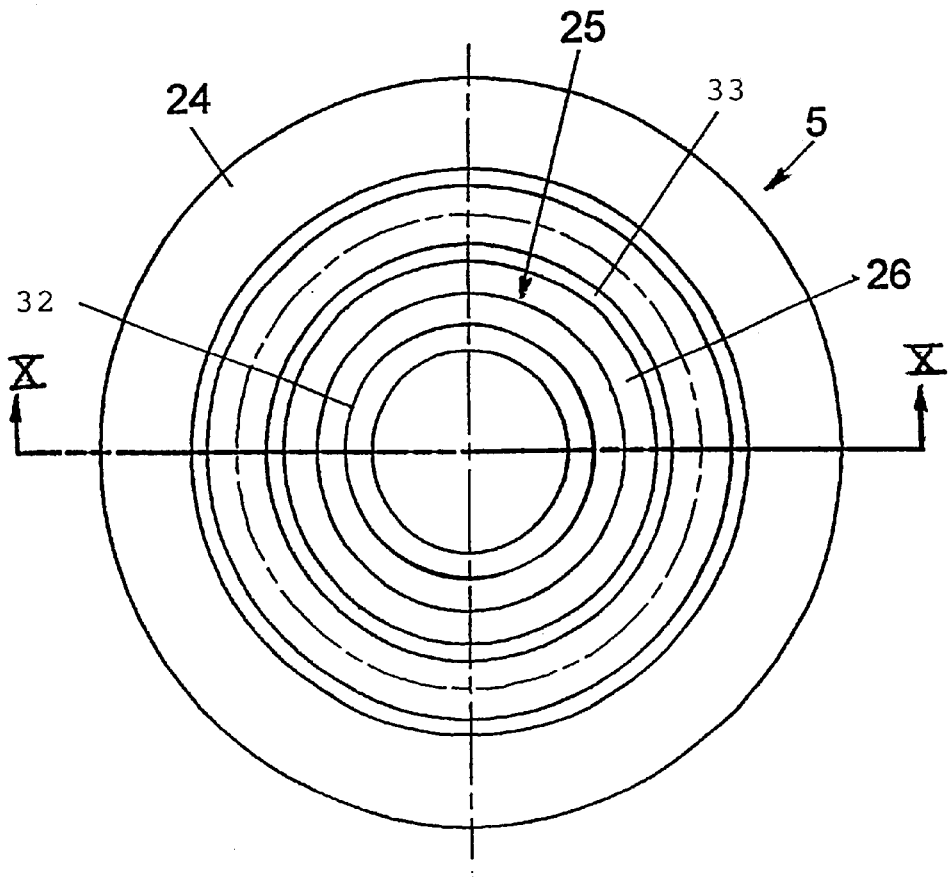
FIG. 9 shows a top view onto a modified take-up reel, its side facing the feed reel being illustrated.

In FIGS. 9 and 10 a slightly modified take-up reel 5 is shown which also comprises a cam guide 25 formed by a front-side, circular groove 26 whose radial inner and outer groove walls are denoted by 32 and 33, respectively. These groove walls 32, 33 are located at a constant distance from each other. On the other hand, the coupling ring 20 again has engaging projections in the form or generally cylindrical engaging pins 28, cf. FIGS. 11 and 12, the centers of which lie on the circle line not illustrated in detail in FIGS. 9 to 11 (cf. 29 in FIG. 7); these engaging pins 28 again are moulded to the free ends of resilient arms 30 extending in peripheral direction, which arms in turn are moulded to the outer side of a ring 31 at angular distances of 120°. Together with the resilient arms 30, this ring 31 forms the coupling ring 20.

If the engaging pins 28 engage in the circular groove 26 on the take-up reel 5, normally all resilient arms 30 will be in their resting positions, in which the engaging pins are located with their centers relaxed on a circle line which defines the middle of the circular groove 26 which, with its walls 32, 33, in FIG. 11 is schematically shown in that Figure at the lower right hand side at the engaging pin 28. As is apparent, the engaging pin 28 (and any other engaging pin 28) abuts the inner wall 32 radially inwardly and the wall 33 radially outwardly, i.e. by a slight pressure fit so as to ensure that the take-up reel 5 will be frictionally entrained by the feed reel 4 under a defined slipping, this being so even if the individual plastics components are subjected to elevated temperatures.

In a tested, practical embodiment which corresponds to FIGS. 9 to 12, the inner wall 32 of the groove 26, or cam guide 25, respectively, had a diameter of 23 mm, and the outer wall 33 had a diameter of 25 mm thus resulting in a groove width of 2 mm with a tolerance of from 0 to −0.005 mm; the engaging pins 28 were circular cylindrical having a diameter of 2 mm, with a tolerance of from 0 to +0.005 mm.

The engaging projections or pins 28 preferably are circular-cylindrical, they may, however, also have a elliptical cross-section, e.g. What is essential is only that they fit tightly into the groove 26 without any play and by the slight pressure fit thus prevailing result in a defined friction both inwardly and outwardly at the walls 32, 33.

From FIGS. 9 and 10 it is furthermore apparent that the disk-shaped base body 24 in this embodiment is designed without holes, apart from the central bearing aperture 34 for putting it onto the axle 18 (FIG. 2). Moreover, from FIGS. 9 and 10 also a cylinder 35 for coiling up the foil tape 1 is visible.

When during operation the foil tape 1 is drawn off the feed or supply reel 4 in that the applicator 7 with the tear-off edge 10 is moved over a substrate, it frictionally entrains the take-up reel 4 via a coupling ring 20 so that the empty foil tape 1 is reeled up there while being guided tightly. In the ideal state, the resilient arms 30 are relaxed, and the take-up reel 5 is entrained merely by the slight pressure fit of the engaging projections or pins 28 between the walls 32, 33 by abutting to both sides of the latter. If there occurs a slight relative shifting of the reels 4, 5 due to tolerances, mainly in the region of the axle 18 or of the bearing apertures, e.g. 34, of the reels 4, 5 accommodating the axle, or if the reels 4, 5 undergo dimensional changes due to temperature variations, the resilient arms 30 can compensate therefor by resilient deflection in the required direction, while nevertheless it is still the friction of the engaging projections 28 in the cam guide 25 which determines the entrainment torque or the safety torque within the desired narrow range.

The resilient arms 30 with the engaging pins 28 may also be moulded in one piece to the take-off reel 4, in which case reel hub 19 itself can form the base for the arms 30.

As the material for the elements described, i.e. the reels 4, 5 and the coupling ring 20, any desired suitable plastics material may be used; in practical experiments, particularly favourable results could be achieved with ABS.

What is claimed is:

1. A reel arrangement for a device for transferring a film located on one side of a foil tape to a substrate, comprising a feed reel for the foil tape, a take-up reel for receiving the foil tape after the film has been transferred, said take-up reel being arranged coaxially with the feed reel, and a friction coupling provided between the two reels so as to drive the take-up reel from the feed reel with slippage occurring between the two reels during friction coupling, wherein the friction coupling comprise at least one radially resilient arm which is non-rotationally connected with one of said reels and which engages an end face cam guide on the other of said reels by means of an engaging projection extending from the resilient arm and wherein said resilient arm is deflectable radially inwardly and outwardly relative to the friction coupling.

2. A reel arrangement according to claim 1, wherein the resilient arm is connected with the feed reel and the cam guide is provided on the take-up reel.

3. A reel arrangement according to claim 1 or 2, wherein the cam guide is formed by an end face groove.

4. A reel arrangement according to claim 1 or 2, comprising three resilient arms angularly disposed at 120° with respect to one another.

5. A reel arrangement according to claim 3, comprising three resilient arms angularly disposed at 120° with respect to one another.

6. A reel arrangement according to claim 1 or 2, wherein said resilient arm is provided with an engaging pin projecting from the resilient arm parallel to the axis of said reels.

7. A reel arrangement according to claim 3, wherein said resilient arm is provided with an engaging pin projecting from the resilient arm parallel to the axis of said reels.

8. A reel arrangement according to claim 5, wherein said resilient arms are each provided with an engaging pin projecting from the respective resilient arm parallel to the axis of said reels.

9. A reel arrangement according to claim 6, wherein said engaging pin is cylindrical.

10. A reel arrangement according to claim 7, wherein said engaging pin is cylindrical.

11. A reel arrangement according to claim 8, wherein said engaging pins are cylindrical.

12. A reel arrangement according to claim 8, wherein said engaging pins are arranged relative to one another on a circumference of an imaginary circle.

13. A reel arrangement according to claim 11, wherein said engaging pins are arranged relative to one another on a circumference of an imaginary circle.

14. A reel arrangement according to claim 1 or 2, wherein said resilient arm has a freely cantilevered end which projects in a direction opposite to a direction of rotation of said reels.

15. A reel arrangement according to claim 4, wherein said resilient arms have freely cantilevered ends which project in a direction opposite to a direction of rotation of said reels.

16. A reel arrangement according to claim 1 or 2, wherein the resilient arm is molded to a ring which is non-rotationally arranged on a hub of said one of the reels.

17. A reel arrangement according to claim 4, wherein the resilient arms are molded to a ring which is non-rotationally arranged on a hub of said one of the reels.

18. A reel arrangement according to claim 16, wherein the ring on its radially inner side has at least one projection which engages a depression in the periphery of said hub.

19. A reel arrangement according to claim 17, wherein the ring on its radially inner side has at least one projection which engages a depression in the periphery of said hub.

20. A reel arrangement according to claim 1 or 2, wherein said cam guide is non-circular in shape.

21. A reel arrangement according to claim 4, wherein said cam guide is non-circular in shape.

22. A reel arrangement according to claim 20, wherein the cam guide is elliptical in shape.

23. A reel arrangement according to claim 21, wherein the cam guide is elliptical in shape.

24. A reel arrangement according to claim 20, wherein the resilient arm deflects radially inwardly and radially outwardly about 0.3 to 0.5 mm.

25. A reel arrangement according to claim 21, wherein the resilient arms deflect radially inwardly and radially outwardly about 0.3 to 0.5 mm.

26. A reel arrangement according to claim 22, wherein the resilient arm deflects radially inwardly and radially outwardly about 0.3 to 0.5 mm.

27. A reel arrangement according to claim 23, wherein the resilient arms deflect radially inwardly and radially outwardly about 0.3 to 0.5 mm.

28. A reel arrangement according to claim 1 or 2, wherein the cam guide is circular and includes an inner wall and a radially outer wall, said projection engaging both walls.

29. A reel arrangement according to claim 4, wherein the cam guide is circular and includes an inner wall and a radially outer wall, said projections engaging both walls.

30. A reel arrangement according to claim 28, wherein a bottom of a groove forming the cam guide is part of a disk-shaped base body of said other reel from which said walls, as well as a tape-coiling cylinder, project axially on one side thereof.

31. A reel arrangement according to claim 29, wherein a bottom of a groove forming the cam guide is part of a disk-shaped base body of said other reel from which said walls, as well as a tape-coiling cylinder, project axially on one side thereof.

32. A reel arrangement according to claim 28, wherein the engaging projection is received with a slight pressure fit between the walls of the circular cam guide.

33. A reel arrangement according to claim 29, wherein the engaging projections are received with a slight pressure fit between the walls of the circular cam guide.

34. A reel arrangement according to claim 30, wherein the engaging projection is received with a slight pressure fit between the walls of the circular cam guide.

35. A reel arrangement according to claim 31, wherein the engaging projections are received with a slight pressure fit between the walls of the circular cam guide.

36. A reel arrangement according to claim 28, wherein the cam guide has a width of 2 mm, with a tolerance of from 0 to −0.005 mm, and the projection has a thickness, as measured in the radial direction of the reels, of 2 mm, with a tolerance of from 0 to +0.005 mm.

37. A reel arrangement according to claim 29, wherein the cam guide has a width of 2 mm, with a tolerance of from 0 to −0.005 mm, and the projections have a thickness, as measured in the radial direction of the reels, of 2 mm, with a tolerance of from 0 to +0.005 mm.

38. A reel arrangement according to claim 30, wherein the cam guide has a width of 2 mm, with a tolerance of from 0 to −0.005 mm, and the projection has a thickness, as measured in the radial direction of the reels, of 2 mm, with a tolerance of from 0 to +0.005 mm.

39. A reel arrangement according to claim 31, wherein the cam guide has a width of 2 mm, with a tolerance of from 0 to −0.005 mm, and the projections have a thickness, as measured in the radial direction of the reels, of 2 mm, with a tolerance of from 0 to +0.005 mm.

40. A reel arrangement according to claim 32, wherein the cam guide has a width of 2 mm, with a tolerance of from 0 to −0.005 mm, and the projection has a thickness, as measured in the radial direction of the reels, of 2 mm, with a tolerance of from 0 to +0.005 mm.

41. A reel arrangement according to claim 33, wherein the cam guide has a width of 2 mm, with a tolerance of from 0 to −0.005 mm, and the projections have a thickness, as measured in the radial direction of the reels, of 2 mm, with a tolerance of from 0 to +0.005 mm.

42. A reel arrangement according to claim 34, wherein the cam guide has a width of 2 mm, with a tolerance of from 0 to −0.005 mm, and the projection has a thickness, as measured in the radial direction of the reels, of 2 mm, with a tolerance of from 0 to +0.005 mm.

43. A reel arrangement according to claim 35, wherein the cam guide has a width of 2 mm, with a tolerance of from 0 to −0.005 mm, and the projections have a thickness, as measured in the radial direction of the reels, of 2 mm, with a tolerance of from 0 to +0.005 mm.

44. A reel arrangement according to claim 1 or 2, wherein the resilient arm is made of ABS.

45. A reel arrangement according to claim 4, wherein the resilient arms are made of ABS.

* * * * *